United States Patent [19]

Jones

[11] 3,966,065

[45] June 29, 1976

[54] SAFETY HOLD-DOWN APPARATUS FOR TRACTOR-MOUNTED EARTH WORKING IMPLEMENTS

[75] Inventor: Joel Flynn Jones, Claremore, Okla.

[73] Assignee: Hesston Corporation, Hesston, Kans.

[22] Filed: Aug. 19, 1974

[21] Appl. No.: 498,581

[52] U.S. Cl. ..... 214/138 R; 172/439; 214/766

[51] Int. Cl.[2] ..... E02F 3/32

[58] Field of Search ..... 172/439; 280/460 A, 280/461 A, 456, 479 R, 479 A; 214/138, 766, 762

[56] References Cited

UNITED STATES PATENTS

| | | | |
|---|---|---|---|
| 2,752,836 | 7/1956 | Pilch | 214/138 R |
| 3,216,589 | 11/1965 | Walker | 214/138 R |
| 3,253,724 | 5/1966 | Marner | 214/138 R |
| 3,583,585 | 6/1971 | Joyce | 214/762 |
| 3,653,523 | 4/1972 | Long et al. | 214/762 |

FOREIGN PATENTS OR APPLICATIONS

| | | | |
|---|---|---|---|
| 864,518 | 4/1961 | United Kingdom | 214/138 R |

*Primary Examiner*—Robert J. Spar
*Assistant Examiner*—Ross Weaver
*Attorney, Agent, or Firm*—Schmidt, Johnson, Hovey & Williams

[57] ABSTRACT

An implement attachment in the form of, for example, a backhoe is mounted on the three-point hitch of a tractor having an internal hydraulic system which is incapable of preventing free upward swinging on the part of the hitch links. The implement itself includes a main frame attached to the hitch and a digging tool swingably mounted on the frame such that substantial resistance to digging by the tool generates a force which tends to lift the frame and the hitch links from the ground. This reaction is counteracted, however, by the application of a hold-down force against the frame at all times through a single-acting piston and cylinder assembly positioned between the tractor and the frame that is disposed in parallel flow relationship with the other hydraulically operated components of the implement such that increased efforts on the part of the digging tool to lift the frame when additional resistance is encountered automatically results in increased hold-down force applied by the piston and cylinder assembly. The hold-down piston and cylinder assembly is so sized that while being capable of exerting all counteractive force necessary to maintain the implement frame in a stable earth-working position during operation, the hitch links and implement can be raised to a transport position by the internal hydraulic system of the tractor without disconnecting the hold-down piston and cylinder assembly.

5 Claims, 4 Drawing Figures

SAFETY HOLD-DOWN APPARATUS FOR TRACTOR-MOUNTED EARTH WORKING IMPLEMENTS

This invention relates to tractor-mounted, earth-working implements designed for attachment to the three-point hitch available on many tractors, and while the implement attachment described hereinafter and shown in the drawings takes the form of a backhoe, it is to be understood at the outset that such is done by way of example only since the principles of the present invention may be utilized with equal degrees of success on many other types of earth-working attachments such as, for example, trenchers and post hole diggers.

The internal hydraulic system of most tractors having a three-point hitch is so arranged that while substantial lifting force can be applied to the hitch links in order to raise a heavy load attached to the outer ends of the links, there is no resistance to upward swinging of the links should external lifting forces be applied thereto, except of course, for the inherent weight of the links. In other words, while the hitch links can lift a load and the hydraulic system can supply a bottom limit to downward swinging of the load, if the load itself were to exert a lifting force on the links, the only resistance to such lifting force would be the inherent weight of the links themselves.

Accordingly, it has heretofore been a serious problem in backhoe attachments mounted on the three-point linkage of a tractor that such attachments have been subject to rather severe instability when digging resistance of any substantial nature is encountered by the digging bucket, the effect of encountering such digging resistance being to generate a lifting force back through the implement which raises the latter and the hitch links substantially off the ground. Inasmuch as the operator may ride on the implement frame to manipulate the controls of the digging tool when the latter is in use, such lifting forces and instability not only have an adverse effect upon digging performance, but also create a dangerous situation for the operator who may be bumped, jostled, shaken and thrown about rather violently as the implement frame abruptly rises and falls. Moreover, because the modern practice is for tractors to be supplied with overhead structures such as roll bars, canopies and the like located behind the driver's seat and above the latter, a potentially dangerous situation is created when it is considered that the operator seated on the backhoe could be thrown upwardly or pinned against the immobile structures during violent action of the backhoe.

Therefore, it is one important object of the present invention to provide safe and secure working conditions for the operator of a hitch-mounted backhoe attachment or the like through the provision of means for firmly and stably holding the backhoe against abrupt rises and falls when digging resistance is encountered as has characterized previous hitch-mounted backhoes.

Another important object of this invention is to provide improved overall digging performance by forcing the digging tool to remain down in proper operating relationship to the work site even when digging resistance is encountered. In this respect, the lifting reaction generated in the attachment when resistance is encountered is actually rerouted and applied downwardly against the attachment to at least the same extent as the reaction itself.

A further important object of this invention is to provide such hold-down force only to the extent actually needed at each particular instant of time and yet, to have such force apply instantaneously when resistance is encountered. In this regard it is an important attribute of this invention that detection and subsequent actuation of a safety valve or the like is not required; the hold-down force is always in effect, but only to the extent determined by the magnitude of the digging reaction.

A still further important object of this invention is to provide the necessary hold-down force as above set forth without eliminating the ability of the internal hydraulic system of the tractor to which the implement is attached to lift the implement through its hitch links to an above-ground, transport position.

An additional important object of this invention is to provide hold-down apparatus of the aforementioned character which is not unduly expensive and which can be readily installed on existing machines without requiring major modifications and adaptations to such machines.

Figure 4:
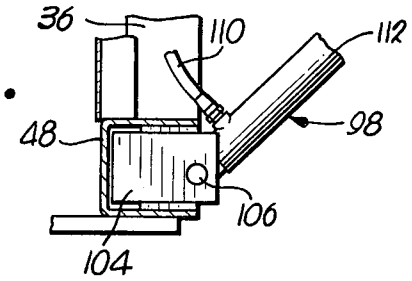
FIG. 4 is an enlarged, fragmentary detail view showing the manner in which the lower end of the hold-down piston and cylinder assembly is coupled to the frame of the backhoe.
Figure 1:
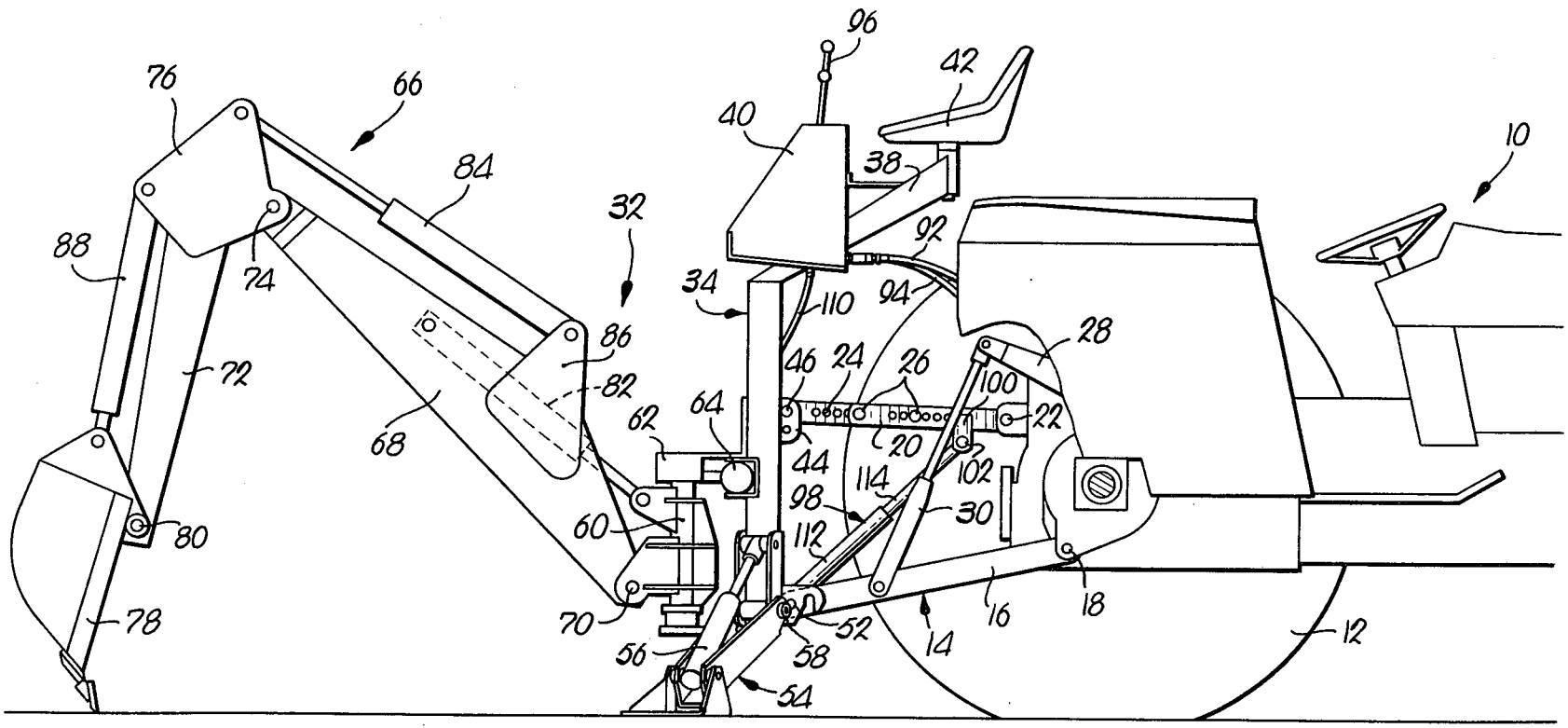
FIG. 1 is a fragmentary side elevational view of a tractor provided with a hitch-mounted backhoe attachment wherein hold-down apparatus constructed and arranged in accordance with the principles of the present invention is utilized.

A prime mover in the form of a conventional tractor 10 has rear ground-engaging wheels 12 (one only being shown) and a three-point hitch 14 that includes a pair of lower liftiing links 16 (one only being shown) swingable about rear horizontal pivots 18 and an upper, centrally located stabilizing link 20 swingable about a horizontal pivot 22. In actual practice, stabilizing link 20 is preferably not the link conventionally supplied with tractor 10, but is instead a special extensible link having a number of holes 24 in overlapping sections of the link to selectively receive a pair of bolts 26 which retain the link in a selected degree of extension. Moreover, the link 20 provides a convenient mounting means for the hold-down apparatus of the present invention as will hereinafter be made clear, but it is important to recognize that the hold-down apparatus may be directly secured to tractor 10 rather than indirectly connected thereto through link 20, either of such arrangements being fully consistent with the principles of this invention. The particular construction of link 20, whether extensible or not, is not critical.

Tractor 10 is provided with its own conventional internal hydraulic system, not shown, which utilizes a hydraulically powered crank arm 28 and an extensible connector 30 to raise and lower each lifting link 16 respectively. While the internal hydraulic circuit of tractor 10 is capable of powered raising of links 16, such circuit provides no resistance whatsoever to the free upward swinging of links 16 about their pivots 18.

An earth-working implement in the nature of a backhoe 32 is detachably mounted on hitch 14 for vertical swinging movement with the latter when hitch 14 is raised and lowered. Backhoe 32 is provided with a generaly A-shaped main frame 34 having side members 36 that converge upwardly to support a single, forwardly inclined member 38 which in turn supports a control console 40 and an operator's seat 42. A pair of outturned, spaced apart lugs 44 carry a cross-pivot 46 to swingably attach the outermost end of stabilizer link 20 to frame 34, and a lowermost, horizontally extending channel 48 has two pairs of mounting lugs 50 at opposite ends thereof having horizontal pivots 52 that swingably attach the outermost ends of lower links 16 to frame 34.

A pair of outrigger-like stabilizers 54 (only one being shown) extend outwardly from opposite lower sides of frame 34, and each is controlled by a piston and cylinder assembly 56 for powered raising and lowering of the stabilizers 54 about pivots 58.

An upright support 60 carried by bracket 62 for swinging about an upright axis may be swung from side-to-side by a piston and cylinder assembly 64, and support 60 carries a digging tool 66 which includes a boom 68 pivoted at 70 to support 60, a member 72 commonly referred to as a "dipper stick" pivoted at 74 to the outer end of boom 68 by a bifurcated mounting plate arrangement 76, and a bucket 78 pivoted at 80 to the outermost end of dipper stick 72. A piston and cylinder assembly 82 between support 60 and boom 68 raises and lowers the latter, another piston and cylinder assembly 84 between upstanding lugs 86 on boom 68 and plates 76 forcibly swings dipper stick 72 about pivot 74, and a third piston and cylinder assembly 88 between plates 76 and bucket 78 controls swinging of the latter about pivot 80.

Figure 2:
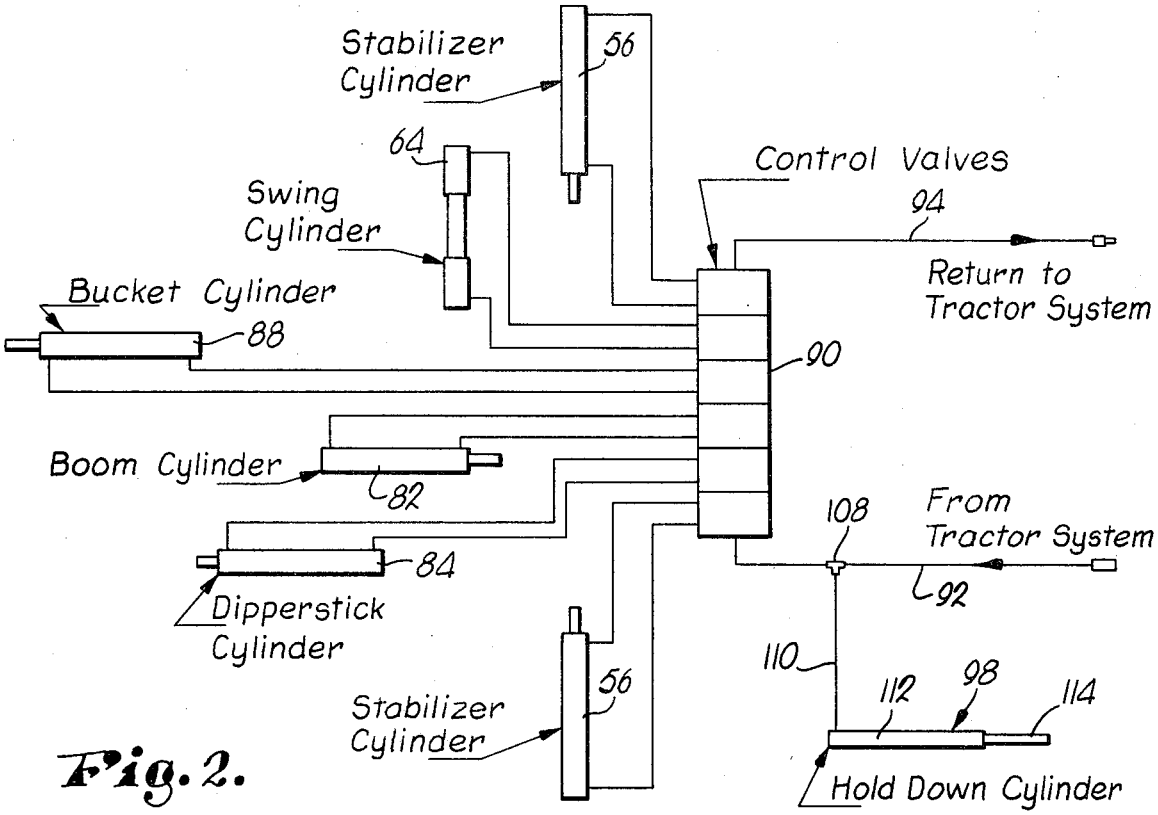
FIG. 2 is a schematic diagram of the hydraulic circuit from the tractor to the backhoe attachment.
Figure 3:
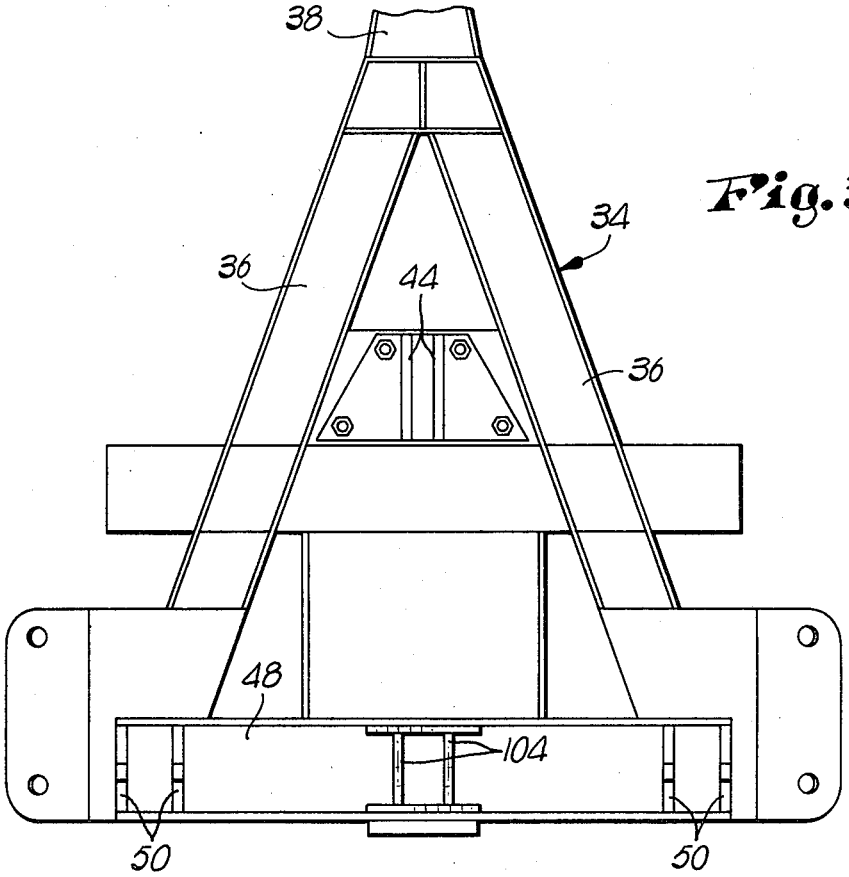
FIG. 3 is an enlarged, fragmentary elevational view of the main frame of the backhoe looking rearwardly from a point just behind the links of the tractor hitch.

With reference particularly being had to FIG. 2, the piston and cylinder assemblies 56, 64, 82, 84 and 88 are all coupled in the conventional manner to the hydraulic system of tractor 10 through a control valve unit 90 housed in console 40. A high pressure line 92 leads into unit 90 from the tractor system, while a return line 94 leads away from unit 90 back to the tractor system. Inasmuch as the specific construction of valve unit 90 is conventional, it will not be disclosed in detail herein. It should suffice to say that, depending upon the position of control levers 96 on console 40, the various piston and cylinder assemblies 56, 64, 82, 84 and 88 may be operated independently of one another or in certain combinations in order to actuate stabilizers 54, swing tool 66 from side-to-side, raise and lower the same, unfold boom 68 and dipper stick 72, and manipulate bucket 78.

All of the foregoing, with the exception of the special construction of extensible link 20, is conventional. In accordance with the principles of the present invention apparatus which includes a special single-acting, fluid-pressure piston and cylinder assembly 98 is inserted between tractor 10 and backhoe 32. More particularly, piston and cylinder assembly 98 is connected between mounting lugs 100 on link 20 having a pivot 102 and mounting lugs 104 on lower channel 48 of frame 34 having a pivot 106. It is important to recognize, however, and this should be readily apparent, that the spcific points of connection for the piston and cylinder assembly 98 at its opposite ends may be varied so long as, in operation, assembly 98 exerts forces in opposite directions between tractor 10 and backhoe 32. In the present arrangement, shown by way of example, force is applied in one direction to backhoe 32 through frame 34 while force is applied in the opposite direction to tractor 10 through link 20 and pivot 22.

A tee connection 108 is made in high pressure line 92, and a line 110 leads from connection 108 to the lower end of cylinder 112 of assembly 98 in order to extend piston shaft 114 when pressurized fluid is introduced into cylinder 112. Assembly 98 is therefore disposed in parallel flow relationship to assemblies 56, 64, 82, 84 and 88, receiving at all times fluid at the same presssure as is directed to valve unit 90 through high pressure line 92.

OPERATION

After the operator has lowered backhoe 32 to a desired level through hitch 14, he leaves the hydrualic system of the tractor energized and climbs into seat 42. Thereupon, he operates the appropriate control lever 96 to actuate assemblies 56 in order to place stabilizers 54 into firm contact with the ground surface 116. As stabilizers 54 engage and begin to press firmly against ground surface 116, a reaction force is generated which tends to lift frame 34 with links 16 about pivots 18. However, concurrently with this reaction force, and as a result of the resistance to further actuation which is encountered by stabilizers 54 and is inherent in hydraulically controlled machins of this type, the pressure in line 92 is caused to rise, and such pressure increase is instantaneously and automatically transmitted to the hold-down piston and cylinder assembly 98 which seeks to extend piston shaft 114 in proportion to the amount of reaction force generated by stabilizers 54. Hence, while a reaction force from stabilizers 54 tries to lift frame 34, a counteracting force at least as great as the lifting force is applied downwardly in the opposite direction against frame 34 by hold-down assembly 98. Accordingly, instead of frame 34 being raised about pivots 18 with links 16, it remains firmly and stably in the location initially selected by the operator when he lowered links 16 to their selected position above the ground. On the one hand, the links 16 are prevented from lowering further by the internal hydraulic system of tractor 10 itself, while on the other hand links 16 and backhoe 32 are prevented from being pushed upwardly as a result of the downwardly applied holding force from piston and cylinder assembly 98.

Having thus established firm and stable support for backhoe 32, the operator may then manipulate such other of the control levers 96 as may be necessary to commence digging with bucket 78. Should bucket 78 encounter substantial resistance to digging, a lifting reaction will be transmitted through dipper stick 72 and boom 68 frame 34, tending to raise the latter and links 16 about pivots 18 in the same manner as the lifting reaction induced when stabilizers 54 are pushed downwardly against ground surface 116. However, once again, while a lifting reaction is created, a hold-down force which automatically and instantaneously counteracts this reaction is also created by virtue of the parallel relationship of holddown assembly 98 with the hydraulic assemblies of backhoe 32. Hence, instead of frame 34 being lifted by the reaction force, frame 32 is maintained firmly in its initial position established by links 16 and stabilizers 54. The fact that bucket 78 may encounter more than just nominal resistance is of no concern, because the greater the resistance encountered by bucket 78, the greater the hold-down force is applied by assembly 98. Of course, should a completely unyielding resistance be encountered by bucket 78, damage to the system will be prevented by a conventional pressure relief valve (not shown) disposed within valve unit 98 that automatically exhausts fluid to return line 94 when a predetermined upper pressure limit is reached.

As is readily apparent, the hold-down assembly 98 is in complete readiness for use at all times, and is, in fact, in actual use to a slight extent at all times so long as pressure is maintained within line 92. In this respect, when fluid is merely circulating through line 92, valve unit 90 and return line 94, a certain minimum pressure exists which is also transmitted to hold-down assembly 98. Hence, even at this time, a slight amount of hold-down force, is applied against frame 34, but such is insufficient to overcome the lifting force of crank arms 28 which are on a separate circuit within tractor 10. Hence, backhoe 32 can be readily lifted to a transport position by lift arms 28 through links 16 even while hydraulic fluid is circulating in a standby condition through line 92, valve 90 and line 94.

It is to be emphasized that in many previous instances the operator stationed in seat 42 was subjected to an extremely violent ride as the frame 32 rose and fell abruptly as digging resistance was encountered and overcome by bucket 78. This severe jarring and shaking of the operator not only made it difficult for him to maintain control, but also resulted in substantial physical abuse leading to possible injury and certainly to early fatigue. Moreover, as earlier mentioned, overhead structures such as roll bars on modern tractors have heretofore presented potential hazards because it was possible for the operator to become pinned between seat 42 and the structure when the backhoe was pushed abruptly upwardly by the reaction to digging resistance.

From the foregoing, it should be clear that the present invention provides two basic needs heretofore lacking in this particular field, i.e., a high degree of safety and comfort for the operator, as well as a high degree of operating performance of the backhoe itself. Both of these facets are provided by virtue of the strong, stable holding action imparted by hold-down assembly 98 of the present invention. While various attempts have been made to solve this problem in the past, including the use of connecting chains between the tractor frame and crank arms 28, as well as arrangements such as a limit valve to divert hydraulic flow back to the tractor system should the backhoe frame be raised too high, such attempted arrangements have been less than satisfactory for a number of reasons, all of which are avoided by the present invention.

Having thus described the invention, what is claimed as new and desired to be secured by Letters Patent is:

1. In earth-working equipment:

a prime mover having a vertically swingable hitch and singleacting, fluid-pressure lifting means for raising said hitch, said lifting means being operable to exert against the hitch an upward force only;

an implement mounted on said hitch for movement therewith when the hitch is raised and lowered, said implement including a frame, a tool shiftably carried by the frame, and first fluid-pressure power means between the frame and the tool for actuating the tool; and apparatus for applying a counteracting hold-down force against the implement during working resistance encountered by the tool, said apparatus including second single-acting, fluid-pressure power means disposed to transmit force between the prime mover and the implement and operable to exert against the implement a downward force only, said second power means being coupled in constant fluid communication with said first power means during actuation of the latter for responding with increased hold-down force to pressure build-up in said first power means.

2. In earth-working equipment as claimed in claim 1, wherein said apparatus is incapable of overcoming said lifting means during actuation of the latter.

3. In earth-working equipment:

a prime mover having a vertically swingable hitch and singleacting, fluid-pressure lifting means for raising said hitch, said lifting means being operable to exert against the hitch an upward force only;

an implement mounted on said hitch for movement therewith when the hitch is raised and lowered, said implement including a frame, a tool shiftably carried by the frame, and first fluid-pressure power means between the frame and the tool for actuating the tool; and apparatus for applying a counteracting hold-down force against the implement during working resistance encountered by the tool, said apparatus including second single-acting, fluid-pressure power means disposed to transmit force between the prime mover and the implement and operable to exert against the implement a downward force only, said second power means being coupled in parallel flow relationship with said first power means.

4. In earth-working equipment as claimed in claim 1, wherein said hitch includes a pair of horizontally spaced lower links and an upper stabilizer link disposed above and between said lower links, said links being connected at their normally outer ends to said frame, said second power means being connected at one end to said frame and at the opposite end to said stabilizer link.

5. In earth-working equipment:

a prime mover having a vertically swingable hitch, a fluid-pressure power supply system, and single-acting, fluid-pressure lifting means for raising said hitch, said lifting means being operable to exert against said hitch an upward lifting force only;

an implement mounted on said hitch for movement therewith when the hitch is raised and lowered, said implement including a frame, a tool shiftably carried by the frame for movement toward and away from the ground, and a fluid-pressure power unit between the frame and the tool for actuating the tool;

a fluid supply line coupled in flow communication with said system;

a fluid return line coupled in flow communication with said system;

a control valve coupled with said lines and said power unit and operable to selectively establish flow communication between said lines and said power unit for actuating the latter;

a single-acting, fluid-pressure hold-down device operably coupled between the prime mover and the implement; and a fluid conduit establishing constant flow communication between said supply line and said hold-down device, said device being operable to exert against said implement a downward force only and being responsive to pressure buildup in said power unit to increase said downward force.

* * * * *